US006412242B1

(12) United States Patent
Elmer

(10) Patent No.: US 6,412,242 B1
(45) Date of Patent: Jul. 2, 2002

(54) FASTENING DEVICE WITH A SINGLE HOLDER FOR FASTENING A GLASS PANEL TO A BUILDING OR THE LIKE AND A PLURALITY OF GLASS PANELS, SUCH AS A BUILDING FACADE, HELD TOGETHER BY A FASTENING DEVICE WITH A SINGLE HOLDER AND A METHOD OF FASTENING A FACADE ON A STRUCTURE, SUCH AS A BUILDING WITH A FASTENING DEVICE WITH A SINGLE HOLDER

(75) Inventor: Hubert Elmer, Innsbruck (AT)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/862,031

(22) Filed: May 18, 2001

Related U.S. Application Data

(63) Continuation-in-part of application No. PCT/EP00/09164, filed on Sep. 19, 2000.

(30) Foreign Application Priority Data

Sep. 21, 1999 (DE) ..... 199 45 196

(51) Int. Cl.[7] ..... E04B 2/88

(52) U.S. Cl. ..... 52/235; 52/52; 52/764; 52/506.05; 439/6; 403/388

(58) Field of Search ..... 52/235, 764, 765, 52/768; D8/349; 439/6

(56) References Cited

U.S. PATENT DOCUMENTS

| | | | | |
|---|---|---|---|---|
| 5,540,514 A | * | 7/1996 | Demars et al. | 403/388 |
| D439,135 S | * | 3/2001 | Elmer | D8/349 |
| 6,254,397 B1 | * | 7/2001 | Elmer | 439/6 |

FOREIGN PATENT DOCUMENTS

| | | |
|---|---|---|
| DE | 29720336 | 4/1998 |
| DE | 19915193 | 11/2000 |

* cited by examiner

*Primary Examiner*—Carl D. Friedman
*Assistant Examiner*—Basil Katcheves
(74) *Attorney, Agent, or Firm*—Nils H. Ljungman & Associates

(57) ABSTRACT

A fastening device for a glass panel (2) on a wall (3), a building-side substructure, or similar object, such as a building facade, using a clamp fitting (4) that grips the glass panel (2) and a holder (5) that is supported on the clamp fitting (4) so that it can move to a limited extent in three dimensions. The invention teaches that the holder (5) has a retaining pivot (6) that can be fixed in position on the clamp fitting (4), whereby on the outer free end (7) of the retaining pivot there is a connecting articulation (8) that can be fixed in position for the connection of a compensating shaft (9), which on its end (10) farther from the retaining pivot (6) is connected by means of an articulation (11) that can be fixed in position with an adapter (12) for fastening to a wall (3), a substructure or similar object.

20 Claims, 6 Drawing Sheets

1
2
3
4
5
6
7,13
8
9
10
11
12
14
15
16
17
18
19
20
21
22
23
24
25

29
26
19
20
30
27

20
29
28

30
6

FASTENING DEVICE WITH A SINGLE HOLDER FOR FASTENING A GLASS PANEL TO A BUILDING OR THE LIKE AND A PLURALITY OF GLASS PANELS, SUCH AS A BUILDING FACADE, HELD TOGETHER BY A FASTENING DEVICE WITH A SINGLE HOLDER AND A METHOD OF FASTENING A FACADE ON A STRUCTURE, SUCH AS A BUILDING WITH A FASTENING DEVICE WITH A SINGLE HOLDER

CONTINUING APPLICATION DATA

This application is a Continuation-In-Part application of International Patent Application No. PCT/EP00/09164, filed on Sep. 19, 2000, which claims priority from Federal Republic of Germany Patent Application No. 199 45 196.6, filed on Sep. 21, 1999. International Patent Application No. PCT/EP00/09164 was pending as of the filing date of this application. The United States was an elected state in International Patent Application No. PCT/EP00/09164.

BACKGROUND OF THE INVENTION

1. Field of the Invention

This invention relates to a fastening device for fastening a glass panel to a wall, a building-side substructure or similar object using a clamp fitting that grips the glass panel and a holder that is supported on the clamp fitting so that it can swivel to a limited extent in three dimensions.

2. Background of the Invention

On fastening devices of the type described above, it is necessary on one hand to realize the clamp fitting or punctiform holder that grips the glass panel itself so that the stresses that are introduced into the glass panel can be neutralized to the greatest extent possible in the vicinity of the clamp fitting itself. On the other hand, it is also necessary to realize the holder that is adjacent to the clamp fitting so that a stress-free connection of the clamp fitting and thus of the glass panel to a building-side substructure, a wall or another glass panel is possible. In particular, for a connection to a substructure or wall, it should thereby be possible to compensate for rather large construction tolerances in the form of an appropriate adaptation capability of the holder.

As disclosed in an older application by the same applicant (German Laid Open Patent Application No. 199 15 193.8 and corresponding U.S. application Ser. No. 09/498,385) that is not yet part of the prior art, the holder is supported in the clamp fitting so that it can move to a limited extent in three dimensions, whereby a cap bell is supported with adjustable bias on the inside clamp element, and between the cap bell and the inside clamp element there is a permanently elastic spring element that permits a relative movement of the cap bell with respect to the clamp element.

OBJECT OF THE INVENTION

The object of the invention is to realize the fastening device so that the stress-free gripping of the glass panel by the associated mounting makes it possible to adjust to rather large construction tolerances of a wall, a substructure or similar object.

SUMMARY OF THE INVENTION

The invention teaches that the object described above can be accomplished by a fastening device for a glass panel on a wall, a building-side substructure or similar object using a clamp fitting that grips the glass panel and a holder that is supported on the clamp fitting so that it can move to a limited extent in three dimensions, characterized by the fact that the holder has a retaining pivot that can be fixed in position on the clamp fitting, whereby on the outer free end of the retaining pivot there is a connecting articulation that can be fixed in position for the connection of a compensating shaft, which on its end farther from the retaining pivot is connected by means of an articulation that can be fixed in position with an adapter for fastening to a wall, a substructure, or similar object.

In other words, the fastening device may comprise a clamp fitting or fitting that can attach to glass, an adapter that can attach to a structure, and a holder that can connect the fitting to the adapter. Between the fitting and the holder and the adapter and the holder, there may be respective articulations that can be fixed into position to compensate for construction tolerances and stress in a glass panel mounted on a structure, such as a building facade.

One possible way that the fitting may be attached to a glass panel is with a bolt. The glass panel can have a hole through which a bolt can be inserted. The fitting can have two end portions, a first end being configured to be attached to the holder and a second end being configured to be attached to a glass panel. After being inserted through a hole in the glass panel, the bolt can be inserted into the second end of the fitting, thereby connecting the fitting to a glass panel. A spacer with a hole for the reception of a bolt can also be placed between the fitting and the glass panel to protect the glass from being damaged by the fitting. If the glass panel comprises two glass panes, a spacer may also be placed between the two panes to protect the glass from being damaged by the bolt.

One possible way that the adapter may be attached to a structure is with a fastening screw or bolt. The adapter has two end portions, a first end configured to be attached to a structure and a second end configured to be attached to the holder. A screw or fastening bolt may be inserted into a hole in the first end of the adapter and then through a hole in the structure to attach the adapter to a structure, such as a facade on a building.

According to the above teaching, the holder has a retaining pivot that can be fastened to a clamp fitting. On the outer free end of the retaining pivot there is a connecting joint that can be fixed in position for the connection of a compensating shaft. On its end that is farther from the connecting bridge, the compensating shaft is connected, by means of a respective joint that can be fixed in position with an adapter for fastening to a wall, a substructure or similar object.

To further explain, the compensating shaft or holder has two end portions, a first end configured to be attached to the adapter and a second end configured to be attached to the fitting. The second end of the holder can be attached to the first end of the fitting to permit limited or even complete rotation or movement of the holder in at least two dimensions with respect to the fitting.

The invention therefore teaches that two articulations, joints, or hinges are located between the glass panel and the substructure so that, during installation, a correct adaptation of the adapter that forms the connection to the substructure or wall is guaranteed or essentially guaranteed. After the two articulations have been fixed in position—apart from the limited three-dimensional movement that is still possible in the vicinity of the clamp fitting—the result is a rigid or essentially rigid fastening unit.

In other words, two articulations form connections between the adapter and the holder and the holder and the fitting respectively. A first articulation can comprise the second end of the adapter and the first end of the holder while a second articulation can comprise the second end of the holder and the first end of the fitting.

Additional characteristics of the invention are described herein.

In one advantageous embodiment of the invention, pivot forks are located on the respective free ends of the retaining pivot and of the adapter. The pivot forks are connected with corresponding pivot brackets on the opposite free ends of the compensating shaft to form an articulation, joint, or hinge that can be fixed in position. It goes without saying that in a kinematic reversal, pivot forks can also be provided on the compensating shaft.

To further explain, one part of an articulation comprises a fork and another part of an articulation comprises a bracket or tongue. The tongue is configured to be disposed in the fork and the two parts can be connected by a screw. The articulations permit a pivotal movement, or movement of the parts of the fastening device in two dimensions. In other words, the articulation points permit back and forth swinging movement of the holder with respect to the corresponding adapter or fitting.

In at least one possible embodiment of the present invention, a first articulation can comprise a second end portion of the adapter comprising a fork and a first end portion of the holder comprising a tongue and a second articulation can comprise a second end of the holder comprising a tongue and a first end of the fitting comprising a fork.

In another possible configuration of the invention, the first articulation can comprise a second end of the adapter comprising a tongue and a first end portion of the holder comprising a fork and the second articulation can comprise a second end of holder comprising a fork and a first end of the fitting comprising a tongue.

In yet another embodiment of the invention, the first articulation may comprise a second end of the adapter comprising a tongue and a first end portion of the holder comprising a fork and the second articulation can comprise a second end portion of the holder comprising a tongue and a first end of the fitting comprising a fork.

In a further configuration of the invention, the first articulation may comprise a second end portion of the adapter comprising a fork and a first end portion of the holder comprising a tongue and the second articulation may comprise a second end of the holder comprising a fork and a first end of the fitting comprising a tongue.

To fix the above-mentioned articulations in position, the pivot forks of the retaining shaft and the pivot brackets of the compensating shaft have aligned borings to receive clamp screws.

In other words, the forks and tongues (brackets) of the pivots, or articulations, can have holes into which screws can be inserted. Tightening the screws can thereby fix the respective articulations into position.

As mentioned above, the holder is supported on the clamp fitting that grips the glass panel so that the holder can move to a limited extent in three dimensions. The invention teaches that this capability is realized because the retaining pivot can be fixed in position on the clamp fitting by means of a cap nut that covers or fits over a cap bell of the clamp fitting.

In at least one possible embodiment of the present invention, one way that the holder can be permitted to rotate to a limited extent is that the coupling bell of the clamp fitting can be configured to permit an adjustable bias. An elastic cushion can be placed between the second end portion of the fitting and the coupling bell to permit limited movement of the coupling bell. The coupling bell can have a hole in its top portion and the second end of the fitting can have a corresponding hole. A screw or bolt can be inserted into the holes to connect the two parts of the fitting. The bottom portion of the coupling bell can have a cylindrical extension into which the first end of the fitting or the retaining pivot can fit. The elastic cushion can permit limited movement of the coupling bell and the first end of the fitting with respect to the second end of the fitting. A nut, or cap nut, can then fit over the bottom of the cap bell and the retaining pivot or first end of the fitting. When the nut is tightened or adjusted, the connection between the first end of the fitting and the coupling bell of the fitting can be tightened.

Another possible way that the first end of the fitting, and the holder when it is attached to the fitting, can be permitted to move to a limited extent in three dimensions is that the inner bottom area of the coupling bell and the first end of the fitting may comprise a rotational part. The rotational part can comprise a split O-ring which can fit into corresponding grooves in the two elements of the rotational part. Before the two elements (retaining pivot and coupling bell) are connected, the O-ring can be placed about a groove in the retaining pivot. Since the O-ring is split, it can be compressed into the groove such that the diameter of the compressed O-ring is less than or equal to the diameter of the exterior of the retaining pivot and less than the diameter of the interior of the coupling bell. The retaining pivot can then be inserted into the coupling bell until the compressed O-ring reaches a slot in the coupling bell. The O-ring can then be seated in both the slot and the groove to provide a retaining function to hold the retaining pivot (first end of the fitting) in the coupling bell in a rotatable fashion.

Yet another possible way that the first end of the fitting or the retaining pivot, and the holder when it is attached to the fitting, can be permitted to move to a limited extent in three dimensions with respect to the fitting is that the fitting can comprise a cap bell or coupling bell connecting its two ends. The coupling bell can have a bottom portion facing away from the fitting. In the bottom portion of the coupling bell, there can be a slot and the retaining pivot or first end of the fitting can fit into the slot with minimal play. The slot can permit rotational movement of the first end of the fitting, and the holder when the holder is attached to the fitting. A retaining flange surrounding the first end of the fitting can hold the first end of the fitting while a support flange of the coupling bell supports the first end of the fitting. A nut or cap nut can fit over the coupling bell. When the nut is tightened, turned, or rotated, the play in the slot of the coupling bell can permit the first end of the fitting to move into different positions in the slot. In other words, the slot can be displaced to move the first end of the fitting to another position in the slot, thereby permitting a limited rotational movement of the first end of the fitting and the holder when it is attached to the fitting.

On one hand, to facilitate the adjustment or adaptation of the holder, in particular of the adapter, during the installation on the wall or similar structure, and on the other hand, to guarantee or virtually guarantee the individual connections, including the fixing of the retaining pivot in position by the cap nut, the cap nut and the compensating shaft have flats on their shell surfaces for the application of a wrench.

In other words, both the nut and the holder (compensating shaft) have flattened portions on their outer surfaces. The flattened portions are configured to receive a wrench. Both the nut and the holder can then be turned with a wrench to adjust or tighten the connections between the various elements of the fastening device.

In an additional embodiment of the invention, the pivot brackets are mounted so that they can rotate in the compensating shaft.

In other words, in addition to the two dimensional pivotal movements of the articulations and the possible rotational movement of the first end of the fitting, the fastening device can also comprise an additional rotational part in at least one end of the holder. The rotational part may comprise a split O-ring as described above. The shaft portion of a holder and an end of a holder may comprise grooves or slots into which the O-ring can fit. The O-ring can be seated in both the slot and the groove of the two elements of the holder to provide a retaining function to hold the end of a holder in the shaft portion of a holder (or vice versa) in a rotatable fashion. In other words, a rotational part can permit at least one of the first end portion of the holder and the second end portion of the holder to be rotated. The flattened portion on the holder can permit rotational adjustment of the holder with respect to the fitting and/or the adapter.

In one configuration of the present invention, a rotational part may be located in the first end portion of the holder, thereby permitting rotational movement of the holder with respect to the adapter.

In another possible configuration of the invention, a rotational part can be located in the second end of the holder, thereby permitting rotational movement of the holder with respect to the fitting.

In yet another possible configuration of the invention, a rotational part can be located in both the first end of the holder and the second end of the holder thereby permitting movement of the holder with respect to the adapter and the fitting.

The above-discussed embodiments of the present invention will be described further herein below. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiment illustrated in the accompanying figures, in which.

DESCRIPTION OF THE PREFERRED EMBODIMENT

Figures 1, 2, 3:
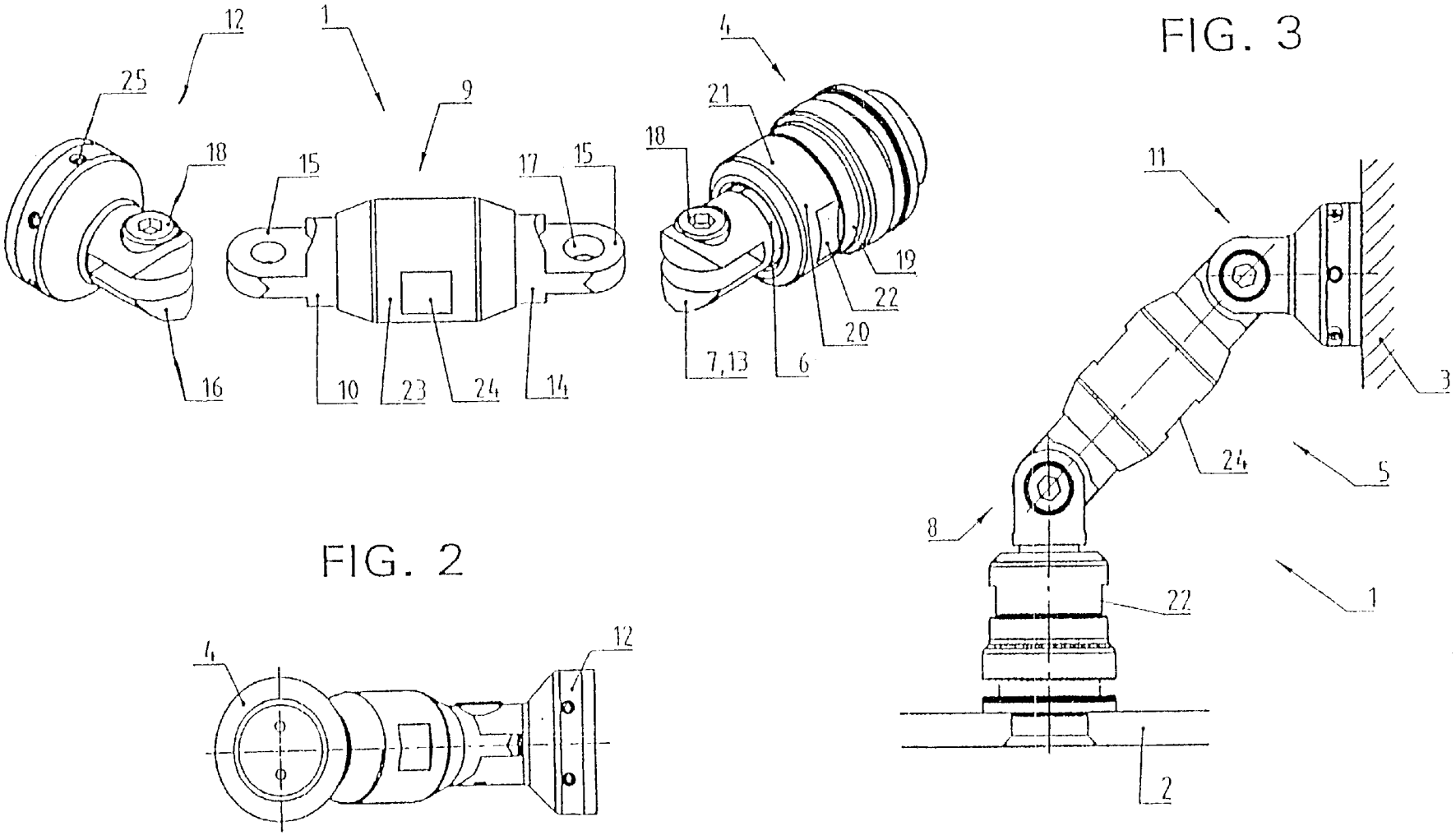
FIG. 1: is an exploded view in perspective of the fastening device.
FIG. 2: is a head-on view.
FIG. 3: is an overhead view of the embodiment illustrated in FIG. 2.

The invention relates to a fastening device for a glass panel (2) on a wall (3), a building-side substructure, or similar object using a clamp fitting (4) that grips the glass panel (2) and a holder (5) that is supported on the clamp fitting (4) so that it can move to a limited extent in three dimensions. The invention teaches that the holder (5) has a retaining pivot (6) that can be fixed in position on the clamp fitting (4), whereby on the outer free end (7) of the retaining pivot there is a connecting articulation (8) that can be fixed in position for the connection of a compensating shaft (9), which on its end (10) farther from the retaining pivot (6) is connected by means of an articulation (11) that can be fixed in position with an adapter (12) for fastening to a wall (3), a substructure or similar object.

With reference to FIG. 1, a fastening device 1 comprises essentially three components, namely a clamp fitting 4, a compensating shaft 9 and an adapter 12, whereby between these two components two articulations 8 and 11 (See FIG. 3) that can be fixed in position are formed. The overall holder is designated 5.

A glass panel 2 is gripped by means of the clamp fitting 4 (see FIG. 3). A retaining pivot 6 is held in the clamp fitting 4 between a cap bell 19 and a cap nut 20 of the clamp fitting 4. A free end 7 of the retaining pivot 6 is realized in the form of a pivot fork 13. The same is true for the adapter 12, which also has a pivot fork 16. The compensating shaft 9, on its free ends 10 and 14, has pivot brackets 15 which are received, held, or contained by the pivot forks 13, 16. Aligned borings 17 run through both the pivot brackets 15 and the pivot forks 13, 16. The articulations 8 and 11 can be rigidly fixed in position by means of clamp screws 18 that run through these aligned borings 17.

As mentioned above, each of the articulations 8, 11 comprises one fork portion and one tongue portion. The tongue fits into the fork to permit pivotal motion in two dimensions. The forks and tongues can be positioned on either part of the articulation 8, 11 in four possible combinations as described above. The screws 18 that can be inserted into the holes 17 in the forks and tongues, or brackets, of the articulations 8, 11 can be tightened to tighten the articulations or fix the articulations 8, 11 into place.

The accompanying figures also show that a shell surface 21 of the cap nut 20 has a flat 22 for the application of a wrench. The same is true of a shell surface 23 of the compensating shaft 9. The corresponding flat is designated 24.

As mentioned, the flattened portions 22 and 24 on the outer surfaces of the nut 20 and the holder (compensating shaft) 9 permit additional rotational adjustment of the parts of the fastening device.

For the adjustment to a wall 3 (shown in FIG. 3) or another glass panel in a building facade, for example, the adapter 12 comprises two components that can be rotated with respect to each other, and can be fixed in position with respect to each other by means of Allen screws 25.

In other words, in addition to the possible rotational movements of the first end of the fitting or retaining pivot 6 and the ends of the holder (compensating shaft) 9, the adapter 12 can also comprise a rotational part possibly comprising a split O-ring that can fit into a slot in one end of the adapter 12 and a groove in the other end of the adapter 12 as described above. The O-ring can be seated in the grooves and slots to provide a retaining function to hold the first end of the adapter 12 in the second end of the adapter 12, or vice versa, in a rotatable fashion. The rotational part can permit the forked or bracketed second end portion of the adapter 12 and the first end portion of the adapter 12 configured to be attached to a structure to rotate with respect to one another. The position of the two parts in relation to one another can be fixed or set by screws, such as Allen screws 25.

Figure 4:
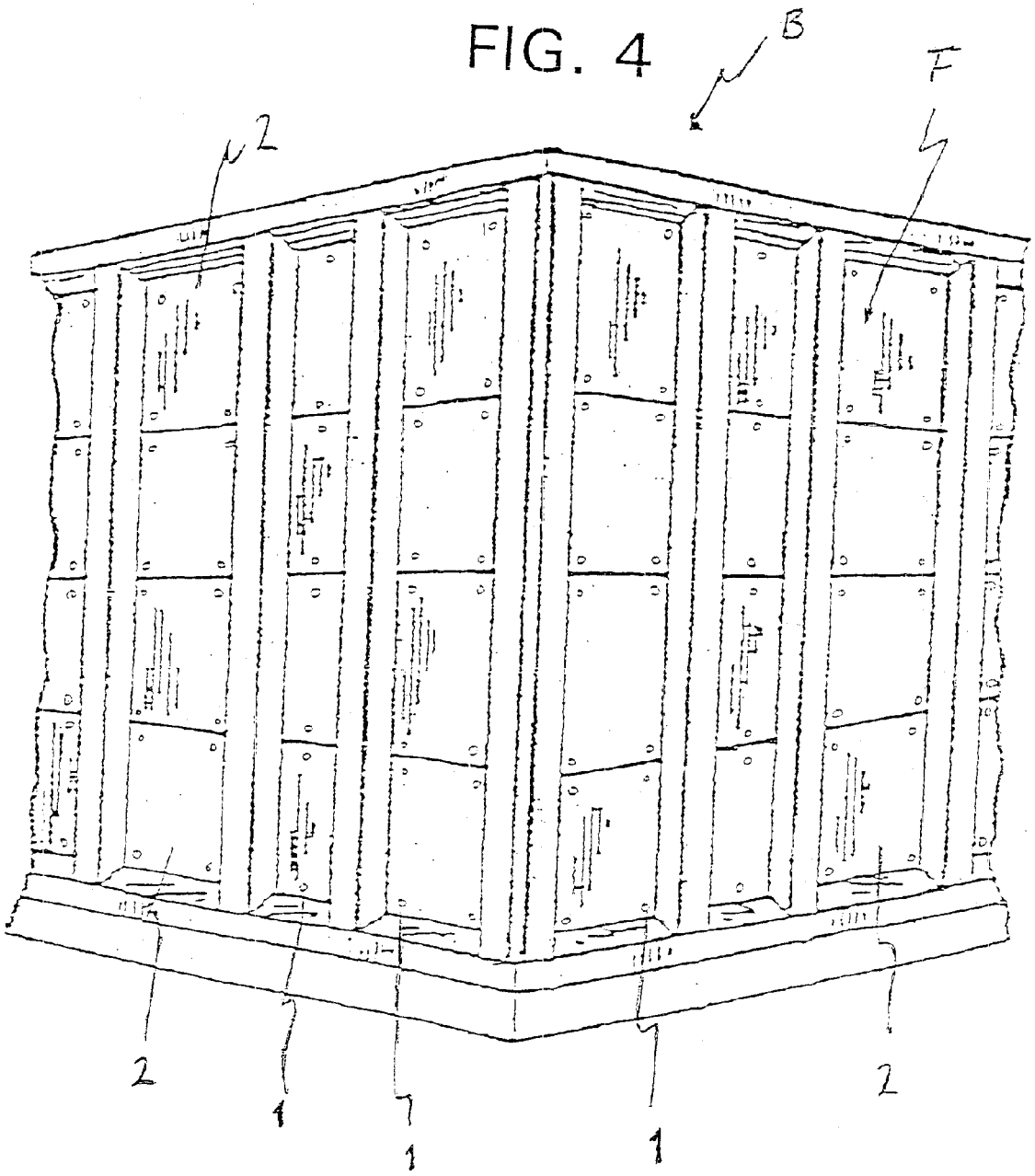
FIG. 4: is a perspective view of a building with a facade.

FIG. 4 shows a building B with a facade F comprising a plurality of glass panels 2. FIG. 4 also shows the attachment of fastening devices 1.

Figure 5:
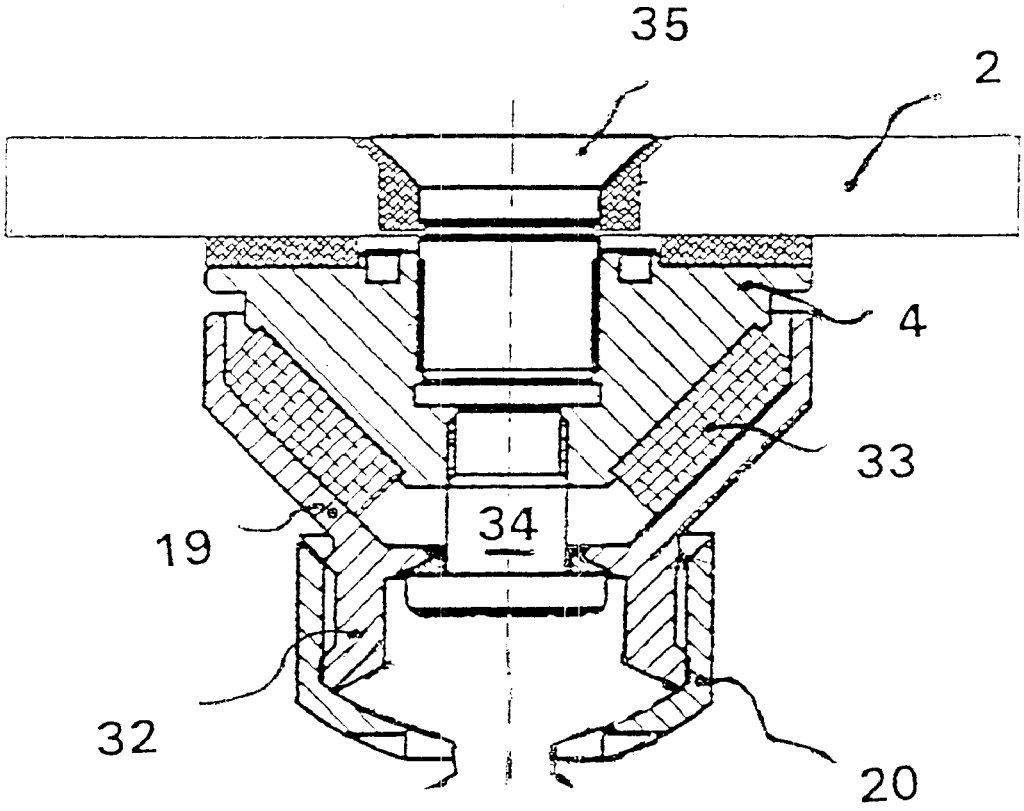
FIG. 5: illustrates a sectional view of a possible configuration of the cap bell of the fitting.

FIG. 5 shows a possible configuration of the coupling bell (cap bell) 19. It also illustrates a possible connection of the second end of the clamp fitting 4 to a glass panel 2. The fitting 4 can be connected to a glass panel 2 via a bolt 35, that can be inserted into corresponding holes in the glass 2 and the fitting 4. The coupling bell 19 can fit over the outer bottom portion of the second end of the fitting 4 to connect the second end of the fitting with the first end of the fitting. The second end portion of the fitting 4 can be connected to the coupling bell 19 by a screw or bolt 34 which fits into corresponding holes in the coupling bell 19 and the second end portion of the fitting 4. An elastic cushion 33 can be disposed between an outer surface of the second end portion of the fitting 4, and an inner surface of the coupling bell 19, to permit adjustable bias or limited movement. The bottom portion of the coupling bell 19 can have a cylindrical extension 32 into which the first end of the fitting or retaining pivot (not shown) can fit. As shown, the cap nut 20 fits over the bottom portion of the cap bell 19. The nut 20 can be adjusted to tighten the connection between the first end of the fitting (not shown) and the cap bell 19 of the fitting.

Figure 6:
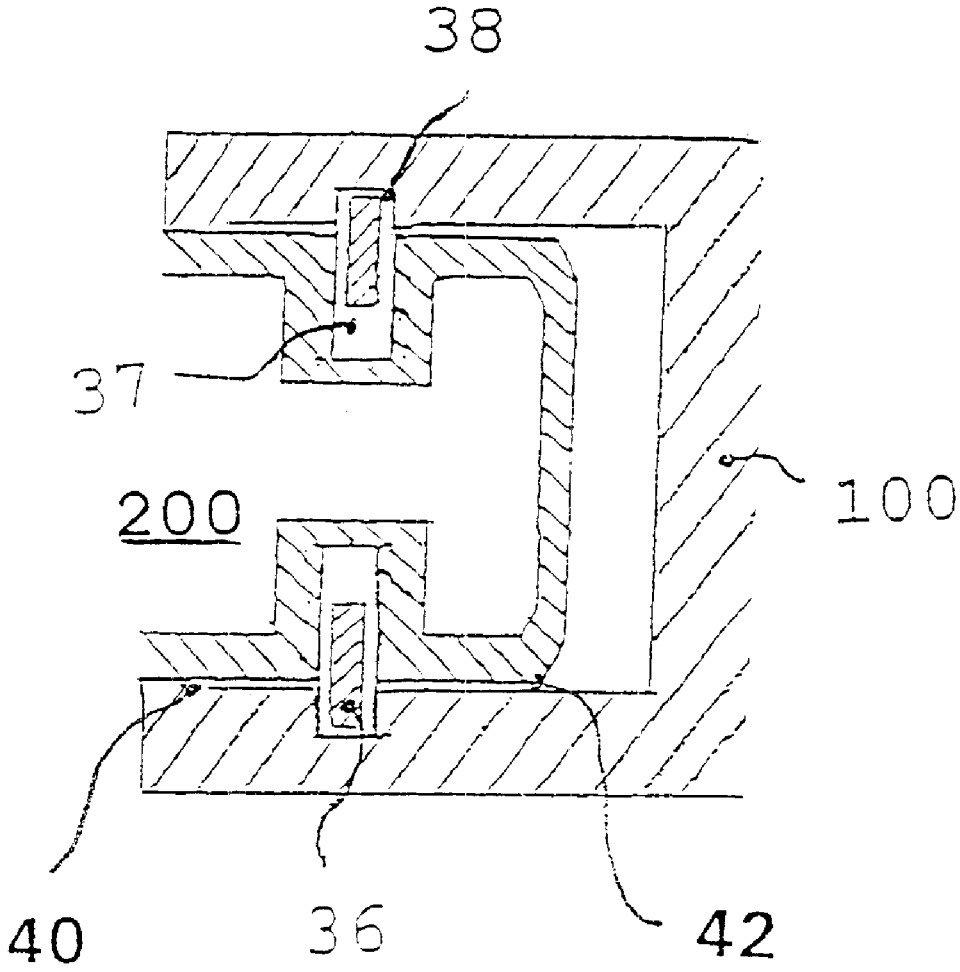
FIG. 6: is a sectional view of a possible configuration of a rotational part.
Figures 8, 9, 10:
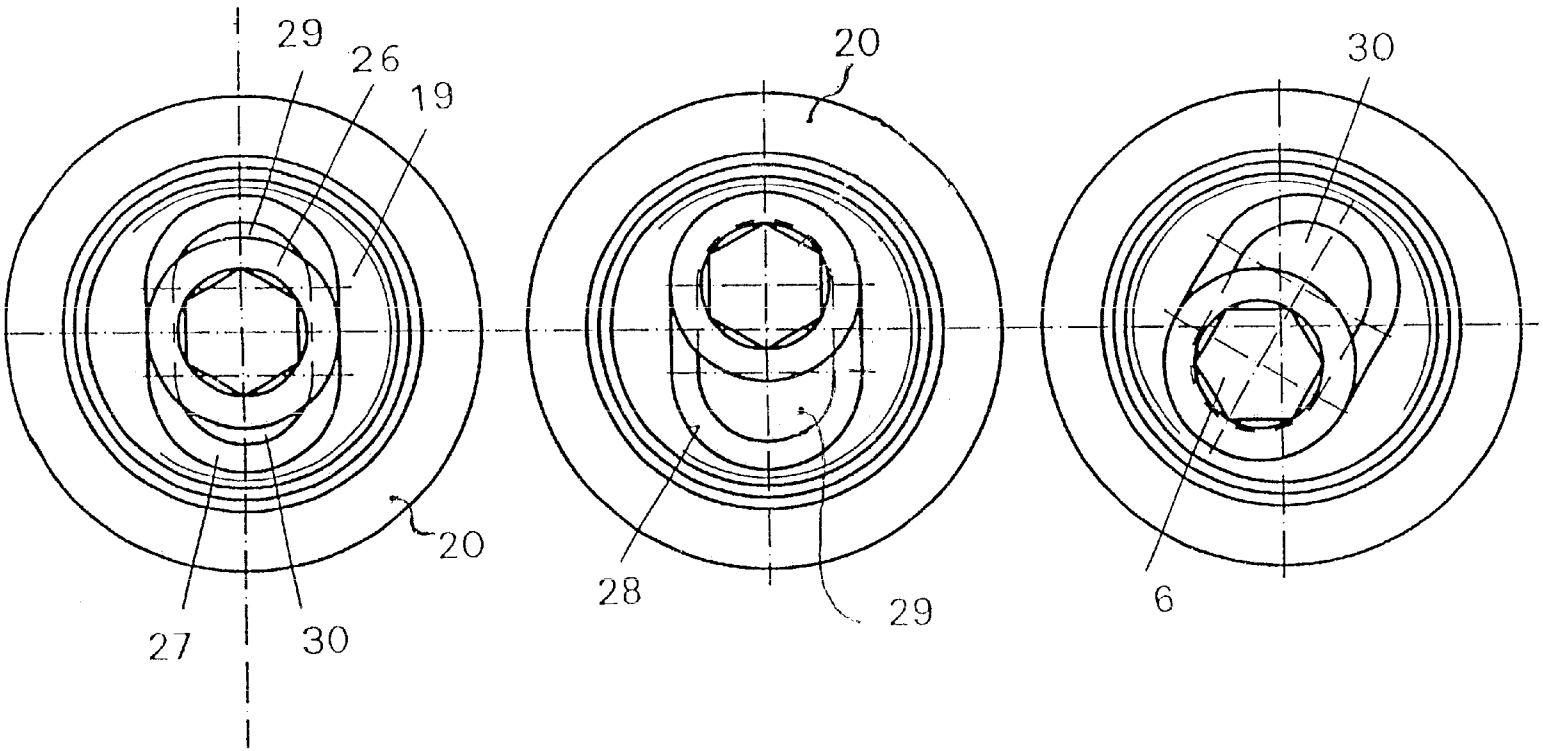
FIG. 8: is a sectional view of another possible configuration of the bottom portion of the cap bell.
FIG. 9: shows a view of the embodiment in FIG. 8 in a different position.
FIG. 10: shows a view of the embodiment in FIG. 8 in a different position.

FIG. 6 shows a possible configuration of a rotational part. The rotational part can be located between the first and second ends of the adapter 12 and/or in one or more of the ends of the holder (compensating shaft) 9. It is also possible for such a rotational part to form the connection between the inner bottom of the coupling bell 19 and the first end of the fitting (retaining pivot) 6. One element 100 of the rotational part can comprise a slot or indentation 38 into which a split O-ring 36 fits. A second element 200 of the rotational part can comprise an end with a groove or indentation 37 into which a split O-ring 36 can fit. The second element 200 can be inserted into the first element 100 to connect the two elements. Before the two elements 100, 200 are connected, the O-ring 36 can be placed about the second element 200 in the groove 37. Because the O-ring 36 is split, it can be compressed into the groove 37 such that the diameter of the compressed O-ring 36 is less than or equal to the diameter 42 of the exterior of the second element 200 and less than the diameter 40 of the interior of the first element 100. The second element 200 can then be inserted into the first element 100 until the compressed O-ring 36 reaches the slot 38. The O-ring 36 can then be seated in both the slot 38 and the groove 37 to provide a retaining function to hold the second element 200 in the first element 100 in a rotatable fashion. The O-ring 36 can fit very tightly into the slot 38 and the groove 37 to avoid any rattling or play. The elements 100, 200 of the rotational part can be hollow as shown or solid. The elements 100, 200 of the rotational part can comprise the two parts of the adapter 12, the first end of the fitting (retaining pivot) 6 and the coupling bell (cap bell) 19 of the fitting 4, or an end 10, 14 of the holder (compensating shaft) 9. FIG. 9 is only one example of a possible rotational connection. There are other ways of connecting the shaft pieces, the adapter pieces, and the clamp fitting pieces together to permit rotation with very little play.

Figure 7:
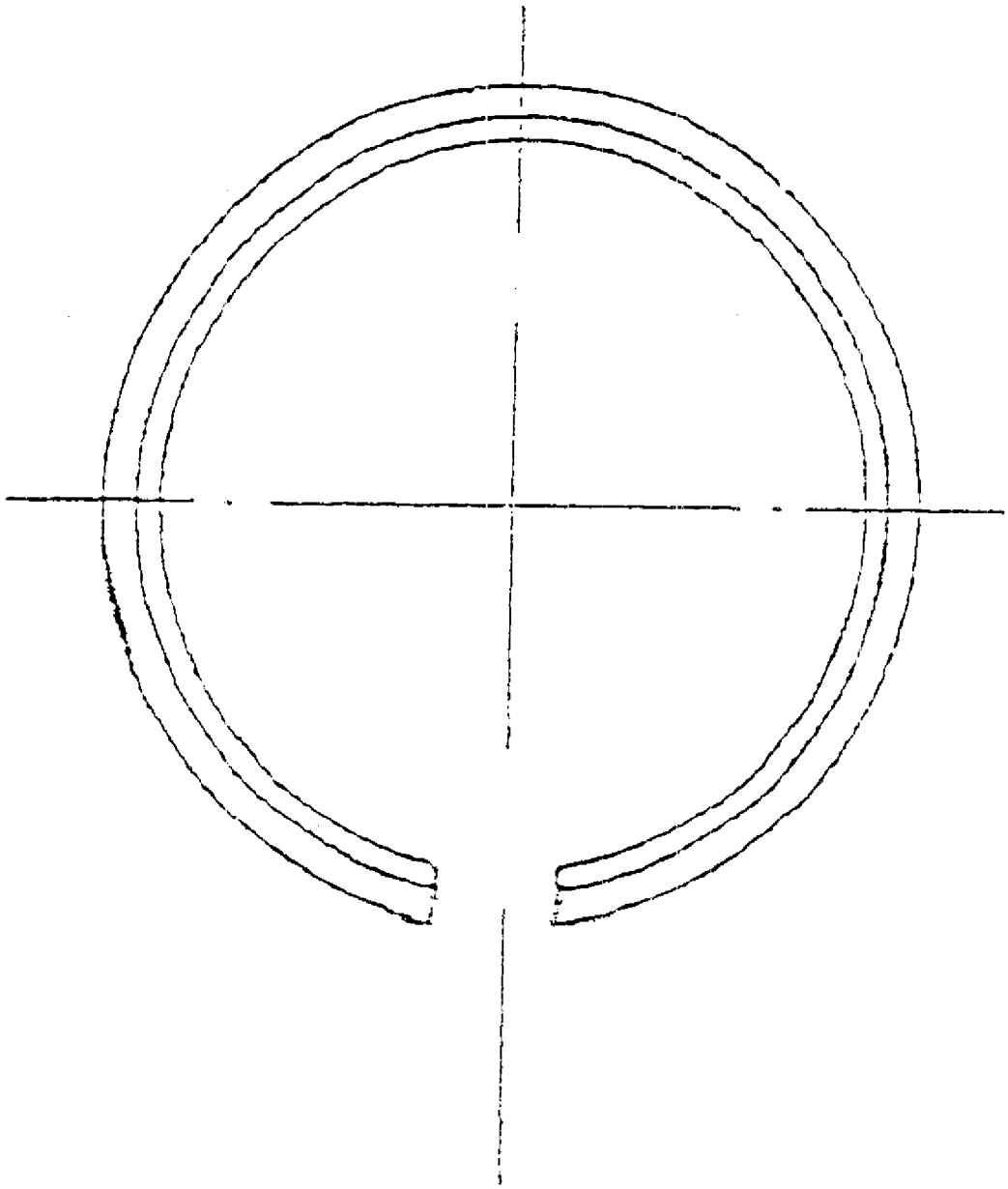
FIG. 7: is a top plan view of a split O-ring.

FIG. 7 shows a possible configuration of a split O-ring, which can comprise part of a rotational part in either the adapter 12, one or more of the ends of the compensating shaft 9, or the clamp fitting 4.

FIGS. 8, 9, and 10 show another possible configuration of the inside bottom area of the coupling bell (cap bell) 19. The bottom of the coupling bell 19 can have a retaining flange 26, which holds the end of the retaining pivot 6 or first end of the fitting and a support flange 27 that can fit into a slot-like groove 28 to support the first end of the fitting or retaining pivot 6. As FIG. 9 shows, the coupling bell (cap bell) 19 can have a slot 29, into which the retaining pivot 6 or first end of the fitting fits with minimal play 28. As shown in FIGS. 9 and 10, when the nut or cap nut 20 is turned, the retaining pivot 6 or first end of the fitting can be displaced in the slot 29 of the coupling bell or cap bell 19.

One feature of the invention resides broadly in a fastening device for a glass panel 2 on a wall 3, a building-side substructure, or similar object using a clamp fitting 4 that grips the glass panel 2 and a holder 5 that is supported on the clamp fitting 4 so that it can move to a limited extent in three dimensions, characterized by the fact that the holder 5 has a retaining pivot 6 that can be fixed in position on the clamp fitting 4, whereby on the outer free end 7 of the retaining pivot there is a connecting articulation 8 that can be fixed in position for the connection of a compensating shaft 9, which on its end 10 farther from the retaining pivot 6 is connected by means of an articulation 11 that can be fixed in position with an adapter 12 for fastening to a wall 3, a substructure or similar object.

Another feature of the invention resides broadly in a fastening device characterized by the fact that a pivot fork 13 is realized on the outer free end 7 of the retaining pivot 6.

Yet another feature of the invention resides broadly in a fastening device characterized by the fact that pivot brackets 15 are located on the opposite free ends 10, 14 of the compensating shaft 9.

Still another feature of the invention resides broadly in a fastening device characterized by the fact that the adapter 12 has a pivot fork 16.

A further feature of the invention resides broadly in a fastening device characterized by the fact that the pivot forks 13, 16 of the retaining pivot 6 and of the adapter 12 and the pivot brackets 15 of the compensating shaft 9 have aligned borings 17 to receive a clamp screw 18.

Another feature of the invention resides broadly in a fastening device characterized by the fact that the retaining pivot 6 can be fixed in position on the clamp fitting 4 by means of a cap nut 20 that covers or fits over a cap bell 19 of the clamp fitting 4.

Yet another feature of the invention resides broadly in a fastening device characterized by the fact that the cap nut 20 has a flat 22 on its shell surface 21 for the application of a wrench.

Still another feature of the invention resides broadly in a fastening device characterized by the fact that the compensating shaft 9 has a flat 24 on its shell surface 23 for the application of a wrench.

A further feature of the invention resides broadly in a fastening device characterized by the fact that the pivot brackets 15 are rotationally mounted in the compensating shaft 9.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 199 45 196.6, filed on Sep. 21, 1999, having inventor Hubert ELMER, entitled, "Befestigungsvorrichtung fur eine glasscheibe" and DE-OS 199 45 196.6 and DE-PS 199 45 196.6 and International Appln. No. PCT/EP00/09164, filed on Sep. 19, 2000 as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. patents and patent applications are hereby incorporated by reference as if set forth in their entirety herein: U.S. Pat. No. 6,131,346, having inventor Herbert KORDES, issued on Oct. 17, 2000 and entitled, "Clamping fitting to attach glass panes"; U.S. Pat. No. 6,158,177, having attorney docket No. NHL-DOR-48 US, having inventor Ernst Udo BLÖBAUM, issued on Dec. 12, 2000 and entitled, "Clamping mounting for glass plates, and a kit to construct a clamping mounting to mount glass plates, and a method to utilize a kit to construct a clamping mounting to mount glass plates"; U.S. patent application Ser. No. 09/731,265, having inventors Ernst Udo BL ÖBAUM and Reinhard JANUTTA, filed on Dec. 6, 2000, and entitled, "Building glass facade of a building, a clamping arrangement for holding glass panels in a glass facade of a building, a brace to hold safety glass panels in a glass facade of a building, and a brace to hold safety glass panels"; U.S. patent application Ser. No. 09/498,385, having inventor Hubert ELMER, filed on Feb. 3, 2000, and entitled, "Attachment device for a glass pane at a mounting fixed to a structure"; U.S. patent application Ser. No. 09/854,411, having inventor Hubert ELMER, claiming priority from German Patent Application No. 199 43 565.0, having inventor Hubert ELMER, filed on Sep. 13, 1999 and entitled, "Klemmbeschlag fur die eckverbinding von drei an einander grenzenden wanden"; U.S. patent application Ser. No. 09/835,865, having inventors Ralf KREYENBORG, Dirk SCHULTE, and Ernst Udo BLÖBAUM, claiming priority from German Patent Application No. 199 38 571.8, having inventors Ralf KREYENBORG, Dirk SCHULTE, and Ernst Udo BLÖBAUM, filed on Aug. 17, 1999 and entitled, "Klemmbeschlag fur die befestigung von glasschieben"; U.S. patent application Ser. No. 09/838,349, having inventor Lothar GINZEL, claiming priority from German Patent Application No. 199 39 172.6, having inventor Lothar GINZEL, filed on Aug. 20, 1999 and entitled, "Punktformige halterung fur isolierglasschieben"; and U.S. patent application Ser. No. 09/861.458, having inventor Hubert ELMER, claiming priority from German Patent Application No. 199 45 197.4, having inventor Hubert ELMER, filed on Sep. 21, 1999 and entitled, "Befestigungsvorrichtung fur eine glasscheibe".

The following foreign patents and patent applications are. hereby incorporated by reference as if set forth in their entirety herein: German Patent No. 197 40 878, having inventor Herbert KORDES, issued on Sep. 17, 1997 and entitled, "Klemmbeschlag fur die befestigung von glasscheiben"; German Patent No. 197 13 038.0, having inventor Ernst Udo BLÖBAUM, issued on Mar. 27, 1997 and entitled, "Klemmbeschlag fur die befestigung von glasscheiben"; German Patent No. 199 15 478.3, having inventors Ernst Udo BLÖBAUM and Reinhard JANUTTA, issued on Apr. 7, 1999 and entitled,"Beschlag zur halterung von sicherheitsglasschieben"; German Patent No. 199 15 193.8, having inventor Hubert ELMER, issued on Apr. 6, 1999 and entitled, "Befestigungsvorrichtung fur eine glasplatte an eine gebaudesteitegen halterung"; German Patent Application No. 199 43 565.0, having inventor Hubert ELMER, filed on Sep. 13, 1999 and entitled, "Klemmbeschlag fur die eckverbinding von drei an einander grenzenden wanden"; German Patent Application No. 199 38 571.8, having inventors Ralf KREYENBORG, Dirk SCHULTE, and Ernst Udo BLÖBAUM, filed on Aug. 17, 1999 and entitled, "Klemmbeschlag fur die befestigung von glasschieben"; German Patent Application No. 199 39 172.6, having inventor Lothar GINZEL, filed on Aug. 20, 1999 and entitled, "Punktformige halterung fur isolierglasschieben"; and German Patent Application No. 199 45 197.4, having inventor Hubert ELMER, filed on Sep. 21, 1999 and entitled, "Befestigungsvorrichtung fur eine glasscheibe".

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

Some examples of glass mountings and glass mounting devices, features of which may possibly be utilized or adapted for use in at least one embodiment of the present invention may be found in the following U.S. Patents: U.S. Pat. No. 5,373,672, issued to Schulz on Dec. 20, 1994; U.S. Pat. No. 5,323,577, issued to Whitmyer on Jun. 28, 1994; U.S. Pat. No. 5,283,978, issued to Horgan, Jr. on Feb. 8, 1994; U.S. Pat. No. 5,212,922, issued to Werner on May 25, 1993; U.S. Pat. No. 4,841,679, issued to Hogg et al. on Jun. 27, 1989; U.S. Pat. No. 4,097,320, issued to Brauer et al. on Jun. 27, 1978; U.S. Pat. No. 4,054,268, issued to Sher on Oct. 18, 1977 and U.S. Pat. No. 4,016,690, issued to Richardson on Apr. 12, 1977. The aforementioned patents are hereby incorporated by reference as if set forth in their entirety herein.

Some examples of glass facades and methods of securing glass panels to a facade, features of which may possibly be utilized or adapted for use in at least one embodiment of the present invention may be found in the following U.S. Patents: U.S. Pat. No. 5,791,105, issued to Gangi on Aug. 11, 1998; U.S. Pat. No. 5,524,404, issued to Lahaye on Jun. 11, 1996; U.S. Pat. No. 5,301,484, issued to Jansson, on Apr. 12, 1996; U.S. Pat. No. 5,493,831, issued to Jansson on Feb. 27, 1996; U.S. Pat. No. 5,373,672, issued to Schulz on Dec. 20, 1994; U.S. Pat. No. 5,184,440, issued to Felix et al. on Feb. 9, 1993; U.S. Pat. No. 5,069,014, issued to Kubbutat on Dec. 3, 1991; U.S. Pat. No. 4,837,996, issued to Eckelt on Jun. 13, 1989; and U.S. Pat. No. 4,793,112, issued to Sufke on Dec. 27, 1988. The aforementioned patents are hereby incorporated by reference as if set forth in their entirety herein.

Some examples of other clamping fittings or connectors, features of which may possibly be utilized or adapted for use in at least one embodiment of the present invention may be found in the following U.S. patents: U.S. Pat. No. 4,115,966, issued to DeLee on Sep. 26, 1978; U.S. Pat. No. 4,409,906, issued to Alneng, on Oct. 18, 1983; U.S. Pat. No. 4,731,973, issued to Stenemann, on Mar. 22, 1988; and U.S. Pat. No. 6,173,545 B1, issued to Feldpausch et al., on Jan. 16, 2001. The aforementioned patents are hereby incorporated by reference as if set forth in their entirety herein.

Some examples of rotating couplings or couplings with split rings, features of which may possibly be utilized or adapted for use in at least one embodiment of the present invention may be found in the following U.S. patents: U.S. Pat. No. 4,448,448, issued to Pollia on May 15, 1984; U.S. Pat. No. 4,850,985, issued to Edwards et al. on Jul. 25, 1989; U.S. Pat. No. 4,954,004, issued to Faber et al. on Sep. 4, 1990; U.S. Pat. No. 5,201,554, issued to Gagg et al. on Apr. 13, 1993; U.S. Pat. No. 5,647,861, issued to Steer et al. on Jul. 15, 1997; U.S. Pat. No. 5,662,628, issued to Hollands on Sep. 2, 1997; U.S. Pat. No. 5,662,629, issued to Steer et al. on Sep. 2, 1997; and U.S. Pat. No. 5,830,200, issued to Steer et al. on Nov. 3, 1998. The aforementioned patents are hereby incorporated by reference as if set forth in their entirety herein.

The invention as described herein above in the context of the preferred embodiments is not to be taken as limited to all of the provided details thereof, since modifications and variations thereof may be made without departing from the spirit and scope of the invention.

NOMENCLATURE

| | |
|---|---|
| 1 | Fastening device |
| 2 | Glass panel |
| 3 | Wall |
| 4 | Clamp fitting |
| 5 | Holder |
| 6 | Retaining pivot |
| 7 | Free end of the retaining pivot |
| 8 | Connecting articulation that can be fixed in position |
| 9 | Compensating shaft |
| 10 | End of the compensating shaft |
| 11 | Articulation that can be fixed in position |
| 12 | Adapter |
| 13 | Pivot fork |
| 14 | End of the compensating shaft |
| 15 | Pivot bracket |
| 16 | Pivot fork |
| 17 | Borings |
| 18 | Clamp screw |
| 19 | Cap bell |
| 20 | Cap nut |

-continued

| | |
|---|---|
| 21 | Shell surface |
| 22 | Flat |
| 23 | Shell surface |
| 24 | Flat |
| 25 | Allen screw |
| 26 | Retaining flange |
| 27 | Support flange |
| 28 | Slot-like groove |
| 29 | Slot |
| 30 | Play |
| 32 | Cylindrical extension of cap bell |
| 33 | Elastic cushion |
| 34 | Screw/bolt |
| 35 | Bolt |
| 36 | Split O-ring |
| 37 | Groove/Indentation |
| 38 | Slot/Indentation |
| 100 | First element of rotational part |
| 40 | Diameter of first element of rotational part |
| 200 | Second element of rotational part |
| 42 | Diameter of second element of rotational part |
| B | Building |
| F | Facade |

What is claimed is:

1. On a building facade structure, a fastening device for attaching a glass panel to a structure, said fastening device comprising:

an adapter being configured to be attached to and being attached to a structure;

a fitting being configured to be attached to and being attached to a glass panel;

a holder being configured to connect and connecting said fitting to said adapter;

said adapter comprising a first end and a second end;

said holder comprising a first end and a second end;

said fitting comprising a first end and a second end;

said first end of said adapter being configured to be attached to and being attached to a structure;

said second end of said adapter being configured to be attached to and being attached to said first end of said holder, said connection forming a first articulation to permit said adapter and said holder to be moved with respect to one another;

said second end of said holder being configured to be attached to and being attached to said first end of said fitting, said connection forming a second articulation to permit said holder and said fitting to be moved with respect to one another;

said second end of said fitting being configured to be attached to and being attached to a glass panel;

at least one of said first articulation and said second articulation being configured to permit back and forth swinging movement and rotational movement between said holder and at least one of said adapter and said fitting in three dimensions;

at least one of said first articulation and said second articulation comprising a rotational part;

at least one of said first articulation and said second articulation being configured to be fixed with respect to the corresponding end of said holder and thus fixing the corresponding one of said adapter and said fitting to said holder; and at least one of said first articulation and said second articulation being configured to compensate for construction tolerances and stress in a glass panel upon attachment of a glass panel to a structure.

2. The fastening device according to claim 1, wherein:

at least one part of at least one of said first articulation and said second articulation comprises a fork;

at least one part of at least one of said first articulation and said second articulation comprises a tongue; and said tongue is configured to be disposed in and is disposed in said fork to provide back and forth swinging movement.

3. The fastening device according to claim 2, wherein one of said first and said second articulations comprises a rotational part being configured to permit movement with a corresponding articulation of at least one of said adapter, said fitting, said first end of said holder, and said second end of said holder in three dimensions.

4. The fastening device according to claim 3, wherein one of said first and said second articulations comprises a rotational part being configured to permit movement with a corresponding articulation of at least two of said adapter, said fitting, said first end of said holder, and said second end of said holder in three dimensions.

5. The fastening device according to claim 4, wherein both said first and said second articulations comprise a rotational part being configured to permit movement with a corresponding articulation of all four of said adapter, said fitting, said first end of said holder, and said second end of said holder in three dimensions.

6. The fastening device according to claim 5, wherein each of said first articulation and said second articulation has a hole being configured to receive a screw, said screw being disposed in said hole and being configured to tighten its corresponding first articulation and second articulation.

7. The fastening device according to claim 6, wherein:

said fitting further comprises a coupling bell being configured to connect and connecting said first end of said fitting and said second end of said fitting;

a nut member being configured to fix said first end of said fitting with respect to said coupling bell of said fitting and being configured to be attached to and being attached to said coupling bell;

said nut member comprises an outer surface having a flattened portion being configured to accept a wrench to permit rotational adjustment of said nut; and said holder comprises an outer surface having a flattened portion being configured to accept a wrench to permit rotational adjustment of said holder.

8. A fastening device for attaching a glass panel to a structure, said fastening device comprising:

an adapter being configured to be attached to a structure;

a fitting being configured to be attached to a glass panel;

a holder being configured to connect said fitting to said adapter;

said adapter comprising a first end and a second end;

said holder comprising a first end and a second end;

said fitting comprising a first end and a second end;

said first end of said adapter being configured to be attached to a structure;

said second end of said adapter being configured to be attached to said first end of said holder, said connection forming a first articulation to permit said adapter and said holder to be moved with respect to one another;

said second end of said holder being configured to be attached to said first end of said fitting, said connection forming a second articulation to permit said holder and said fitting to be moved with respect to one another;

said second end of said fitting being configured to be attached to a glass panel;

at least one of said first articulation and said second articulation being configured to permit back and forth swinging movement between said holder and at least one of said adapter and said fitting in at least two dimensions; and at least one of said first articulation and said second articulation being configured to be fixed with respect to the corresponding end of said holder and thus fixing the corresponding one of said adapter and said fitting to said holder.

9. The fastening device according to claim 8, wherein at least one of said adapter, said fitting, said first end of said holder, and said second end of said holder comprises a rotational part being configured to permit movement with a corresponding articulation of at least one of said adapter, said fitting, said first end of said holder, and said second end of said holder in three dimensions.

10. The fastening device according to claim 9, wherein at least two of said adapter, said fitting, said first end of said holder, and said second end of said holder comprise a rotational part being configured to permit movement with a corresponding articulation of at least two of said adapter, said fitting, said first end of said holder, and said second end of said holder in three dimensions.

11. The fastening device according to claim 10, wherein at least three of said adapter, said fitting, said first end of said holder, and said second end of said holder comprise a rotational part being configured to permit movement with a corresponding articulation of at least three of said adapter, said fitting, said first end of said holder, and said second end of said holder in three dimensions.

12. The fastening device according to claim 11, wherein all of said adapter, said fitting, said first end of said holder, and said second end of said holder comprise a rotational part being configured to permit movement with a corresponding articulation of said adapter, said fitting, said first end of said holder, and said second end of said holder in three dimensions.

13. The fastening device according to claim 12, wherein:

at least one part of at least one of said first articulation and said second articulation comprises a fork;

at least one part of at least one of said first articulation and said second articulation comprises a tongue; and said tongue is configured to be disposed in said fork to provide back and forth movement.

14. The fastening device according to claim 13, wherein each of said first articulation and said second articulation has a hole being configured to receive a screw, said screw being configured to tighten said first articulation and said second articulation.

15. The fastening device according to claim 14, wherein:

said fitting further comprises a coupling bell being configured to connect said first end of said fitting and said second end of said fitting;

a nut member being configured to fix said first end of said fitting with respect to said coupling bell of said fitting and being configured to be attached to said coupling bell;

said nut member comprises an outer surface having a flattened portion being configured to accept a wrench to permit rotational adjustment of said nut member; and said holder comprises an outer surface having a flattened portion being configured to accept a wrench to permit rotational adjustment of said holder.

16. A method of fastening a facade on a structure, such as a building, with a fastening device for attaching a glass panel to a structure, said fastening device comprising: an adapter being configured to be attached to a structure; a fitting being configured to be attached to a glass panel; a holder being configured to connect said fitting to said adapter; said adapter comprising a first end and a second end; said holder comprising a first end and a second end; said fitting comprising a first end and a second end; said first end of said adapter being configured to be attached to a structure; said second end of said adapter being configured to be attached to said first end of said holder, said connection forming a first articulation to permit said adapter and said holder to be moved with respect to one another; said second end of said holder being configured to be attached to said first end of said fitting, said connection forming a second articulation to permit said holder and said fitting to be moved with respect to one another; said second end of said fitting being configured to be attached to a glass panel; at least one of said first articulation and said second articulation being configured to permit back and forth swinging movement between said holder and at least one of said adapter and said fitting in at least two dimensions; and at least one of said first articulation and said second articulation being configured to be fixed with respect to the corresponding end of said holder and thus fixing the corresponding one of said adapter and said fitting to said holder;

said method comprising the steps of:

attaching said second end of said adapter to said first end of said holder to form said first articulation;

attaching said second end of said holder to said first end of said fitting to form said second articulation;

attaching said first end of said adapter to a structure;

adjusting said first articulation and said second articulation to compensate for tolerances;

fastening said second end of said fitting to a glass panel; and tightening said first articulation and said second articulation to secure connection of said fastening device to a glass panel and a structure.

17. The method of fastening a facade on a structure, such as a building, with a fastening device according to claim 16, wherein at least one of said adapter, said fitting, said first end of said holder, and said second end of said holder comprises a rotational part being configured to permit movement with a corresponding articulation of at least one of said adapter, said fitting, said first end of said holder, and said second end of said holder in three dimensions; and said method further comprises the step of rotating said rotational part in at least one of said adapter, said fitting, said first end of said holder, and said second end of said holder.

18. The method of fastening a facade on a structure, such as a building, with a fastening device according to claim 17, wherein said adapter, said fitting, said first end of said holder, and said second end of said holder comprise a rotational part being configured to permit movement with a corresponding articulation of all four of said adapter, said fitting, said first end of said holder, and said second end of said holder in three dimensions; and said method further comprises the step of rotating said rotational part in all four of said adapter, said fitting, said first end of said holder, and said second end of said holder to fasten a facade on a structure.

19. The method of fastening a facade on a structure, such as a building, with a fastening device according to claim 18, wherein at least one part of at least one of said first articulation and said second articulation comprises a fork; at least one part of at least one of said first articulation and said second articulation comprises a tongue; and said tongue is configured to be disposed in said fork to provide back and forth swinging movement; and said method further comprises the steps of:

inserting said tongue into said fork to form at least one of said first and said second articulations and to provide back and forth swinging movement.

20. The method of fastening a facade on a structure, such as a building, with a fastening device according to claim 19, wherein each of said first articulation and said second articulation has a hole being configured to receive a screw, said screw being configured to tighten said first articulation and said second articulation; said fitting further comprises a coupling bell being configured to connect said first end of said fitting and said second end of said fitting; a nut member being configured to fix said first end of said fitting with respect to said coupling bell of said fitting and being configured to be attached to said coupling bell; said nut member comprises an outer surface having a flattened portion being configured to accept a wrench to permit rotational adjustment of said nut member; and said holder comprises an outer surface having a flattened portion being configured to accept a wrench to permit rotational adjustment of said holder; and said method further comprises the steps of:

inserting said screws into said holes in said first and said second articulations;

tightening said screws to fix said first and said second articulations into position;

attaching said coupling bell to said first end and to said second end of said fitting;

attaching said nut member to said coupling bell;

adjusting said nut member to tighten the connection between said first end of said fitting and said coupling bell; and adjusting said holder to tighten the connection between at least one of said first end and said second end of said holder and the corresponding at least one of said adapter and said fitting.

* * * * *